US009879672B2

(12) United States Patent
Moetakef

(10) Patent No.: US 9,879,672 B2
(45) Date of Patent: Jan. 30, 2018

(54) GEROTOR PUMP FOR A VEHICLE

(71) Applicant: Ford Global Technologies, LLC, Dearborn, MI (US)

(72) Inventor: Mohammad Ali Moetakef, West Bloomfield, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 142 days.

(21) Appl. No.: 14/929,748

(22) Filed: Nov. 2, 2015

(65) Prior Publication Data

US 2017/0122316 A1 May 4, 2017

(51) Int. Cl.

| | |
|---|---|
| ***F04C 15/00*** | (2006.01) |
| ***F04C 15/06*** | (2006.01) |
| ***F01M 1/02*** | (2006.01) |
| ***F04C 2/10*** | (2006.01) |
| ***F04C 2/08*** | (2006.01) |

(52) U.S. Cl.

CPC ..... *F04C 15/0049* (2013.01); *F01M 1/02* (2013.01); *F04C 2/088* (2013.01); *F04C 2/102* (2013.01); *F01M 2001/0238* (2013.01); *F04C 2210/206* (2013.01); *F04C 2240/30* (2013.01); *F04C 2270/13* (2013.01)

(58) Field of Classification Search

CPC ..... F01M 1/02; F01M 2001/0238; F04C 15/0042; F04C 15/0061; F04C 15/06; F04C 15/0049; F04C 2270/13; F04C 2/088

See application file for complete search history.

(56) References Cited

U.S. PATENT DOCUMENTS 3,007,419 A * 11/1961 Burt ..... F04C 14/226 418/180
3,145,662 A * 8/1964 Eickmann ..... F01C 21/006 137/508
3,917,437 A * 11/1975 Link ..... F01C 1/104 418/125
4,235,217 A * 11/1980 Cox ..... F01C 1/103 123/232

(Continued)

FOREIGN PATENT DOCUMENTS

EP 0466351 A1 1/1992
JP 2002276559 A 9/2002

(Continued)

*Primary Examiner* — Mark Laurenzi
*Assistant Examiner* — Anthony Ayala Delgado
(74) *Attorney, Agent, or Firm* — Brooks Kushman P.C.; Greg Brown

(57) ABSTRACT

A gerotor pump has a pump housing defining a chamber and having a fluid inlet and a fluid outlet. An outer gear member is supported for rotation within the chamber about a first axis, the outer gear member having a series of internal teeth. An inner gear member or inner rotor is rotatably supported within the outer gear member about a second axis spaced apart from the first axis. The inner gear member defining a series of external teeth interposed with a series of external pockets. The inner gear member defines a fluid passage therethrough to fluidly connect two nonadjacent pockets, with another pocket independent of fluid passages. The fluid passage is configured to disrupt harmonics during operation to reduce pressure ripples and associated tonal noise.

18 Claims, 5 Drawing Sheets

(56) References Cited

U.S. PATENT DOCUMENTS

| | | | | |
|---|---|---|---|---|
| 5,064,362 | A * | 11/1991 | Hansen | F04C 15/06 418/15 |
| 7,481,633 | B2 | 1/2009 | White, Jr. | |
| 7,618,247 | B1 | 11/2009 | Niemiec | |
| 7,832,997 | B2 | 11/2010 | Williamson et al. | |
| 2002/0076345 | A1* | 6/2002 | Hansen | F04C 2/105 418/61.3 |
| 2011/0194968 | A1 | 8/2011 | Nakagawa et al. | |
| 2015/0315913 | A1* | 11/2015 | Peter | F01C 1/103 418/61.3 |

FOREIGN PATENT DOCUMENTS

| | | | |
|---|---|---|---|
| KR | 1020060025367 | A | 3/2006 |
| WO | 2004046554 | A1 | 6/2004 |

* cited by examiner

GEROTOR PUMP FOR A VEHICLE

TECHNICAL FIELD

Various embodiments relate to a gerotor oil pump for a powertrain component such as an internal combustion engine or a transmission in a vehicle.

BACKGROUND

An oil pump is used to circulate oil or lubricant through powertrain components such as an engine or a transmission. The oil pump is often provided as a generated rotor or gerotor pump. Gerotor pumps have a positive displacement characteristic and tight clearances between various components of the pump that result in the formation of pressure ripples or fluctuations of the fluid within the pump and the attached oil galleries during operation of the pump. The pressure ripples of the fluid in the pump may act as a source of excitation to powertrain components, for example, when the pump is mounted to the powertrain components. For example, the pump may be mounted to an engine block, a transmission housing, an oil pan or sump housing, a transmission bell housing, and the like, where the pressure ripples may cause tonal noise or whine from the engine or the transmission. This oil pump-induced powertrain whine or tonal noise is a common noise, vibration, and harshness (NVH) issue, and mitigation techniques may include countermeasures such as damping devices that are added to the powertrain to reduce noise induced by a conventional pump.

SUMMARY

In an embodiment, a gerotor pump is provided with a pump housing defining a chamber and having a fluid inlet and a fluid outlet. An outer gear member is supported for rotation within the chamber about a first axis, the outer gear member having a series of internal teeth. An inner gear member is rotatably supported within the outer gear member about a second axis spaced apart from the first axis. The inner gear member defining a series of external teeth interposed with a series of external pockets. The inner gear member defines a fluid passage therethrough to fluidly connect two nonadjacent pockets, with another pocket independent of fluid passages. The fluid passage is configured to disrupt harmonics during operation to reduce pressure ripples and associated tonal noise.

In another embodiment, a gerotor pump is provided with a housing forming an inlet and an outlet in a chamber. The pump has an inner rotor positioned within an idler rotor, and having first, second and third dedendum regions arranged sequentially. The inner rotor defines a fluid passage extending between the first and third dedendum regions, with the second dedendum region being without fluid passages.

In yet another embodiment, an inner rotor for a gerotor pump is provided with a body having first and second end walls separated by an outer wall defining a series of teeth. The body defines a fluid passage having a first end intersecting a first face of a first tooth and a second end intersecting a second opposed face of a second tooth, the first and second teeth being adjacent.

Various embodiments according to the present disclosure have associated, non-limiting advantages. For example, a gerotor oil pump may be provided with an inner rotor with a fluid passage extending across two teeth to fluidly connect nonadjacent pockets or pumping chambers. By putting fluid passageways between some alternating pockets of the inner rotor, while leaving the remaining pockets without fluid passageways, the main harmonics of the oil pump can be broken into lower peaks resulting in reduced pressure ripples and oil pump tonal noise.

DETAILED DESCRIPTION

Figure 1:
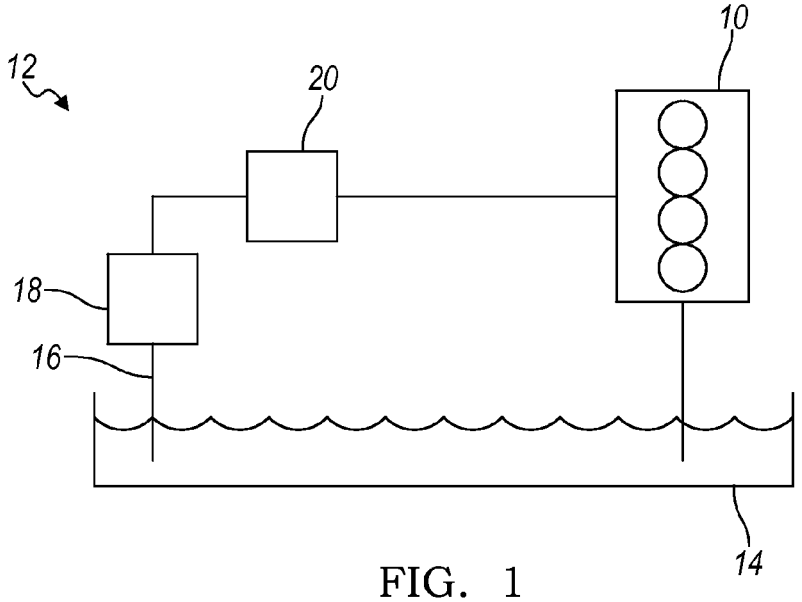
FIG. 1 illustrates a schematic of a lubrication system for a component in a vehicle according to an embodiment.

As required, detailed embodiments of the present disclosure are provided herein; however, it is to be understood that the disclosed embodiments are merely examples and may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present disclosure.

A vehicle component 10, such as an internal combustion engine or transmission in a vehicle, includes a lubrication system 12. The vehicle component 10 is described herein as an engine, although use with other vehicle components is contemplated. The lubrication system 12 provides a lubricant, commonly referred to as oil, to the engine during operation. The lubricant or oil may include petroleum-based and non-petroleum-synthesized chemical compounds, and may include various additives. The lubrication system 12 circulates oil and delivers the oil under pressure to the engine 10 to lubricate rotating bearings, moving pistons and engine camshaft. The lubrication system 12 may additionally provide cooling of the engine. The lubrication system 12 may also provide the oil to the engine for use as a hydraulic fluid to actuate various tappets, valves, and the like.

The lubrication system 12 has a sump 14 for the lubricant. The sump 14 may be a wet sump as shown, or may be a dry sump. The sump 14 acts as a reservoir for the oil. In one example, the sump 14 is provided as an oil pan connected to the engine and positioned below the crankshaft.

The lubrication system 12 has an intake 16 providing oil to an inlet of a pump 18. The intake 16 may include a strainer and is in fluid contact with oil in the sump 14.

The pump 18 receives oil from the intake 16 and pressurizes and drives the oil such that it circulates through the system 12. The pump 18 is described in greater detail below with reference to FIGS. 2-6. In one example, the pump 18 is driven by a rotating component of the engine 10, such as a belt or mechanical gear train driven by the camshaft. In other examples, the pump 18 may be driven by another device, such as an electric motor.

The oil travels from the pump 18, through an oil filter 20, and to the vehicle component or engine 10. The oil travels through various passages within the engine 10 and then leaves or drains out of the engine 10 and into the sump 14.

The lubrication system 12 may also include an oil cooler or heat exchanger to reduce the temperature of the oil or lubricant in the system 12 via heat transfer to a cooling medium such as environmental air. The lubrication system 12 may also include additional components that are not shown including regulators, valves, pressure relief valves, bypasses, pressure and temperature sensors, and the like.

In other examples, the pump 18 may be implemented on other vehicle systems, for example, as a fuel pump, and the like.

FIGS. 2-6 illustrate a pump 50 and various components thereof. The pump 50 may be used in the lubrication system 12 as pump 18. The pump 50 has a housing 52 and a cover. The housing 52 and the cover cooperate to form an internal chamber 56. The cover connects to the housing 52 to enclose the chamber 56. The cover may attach to the housing 52 using one or more fasteners, such as bolts, or the like. A seal, such as an O-ring or a gasket, may be provided to seal the chamber 56.

The internal chamber 56 may be provided with or defined by a substantially cylindrical support or guide wall 57. The guide wall 57 may include one or more sections of wall that have a common radius of curvature and center. Various sections of the guide wall 57 may lie about a perimeter of a common cylinder.

Figure 2:
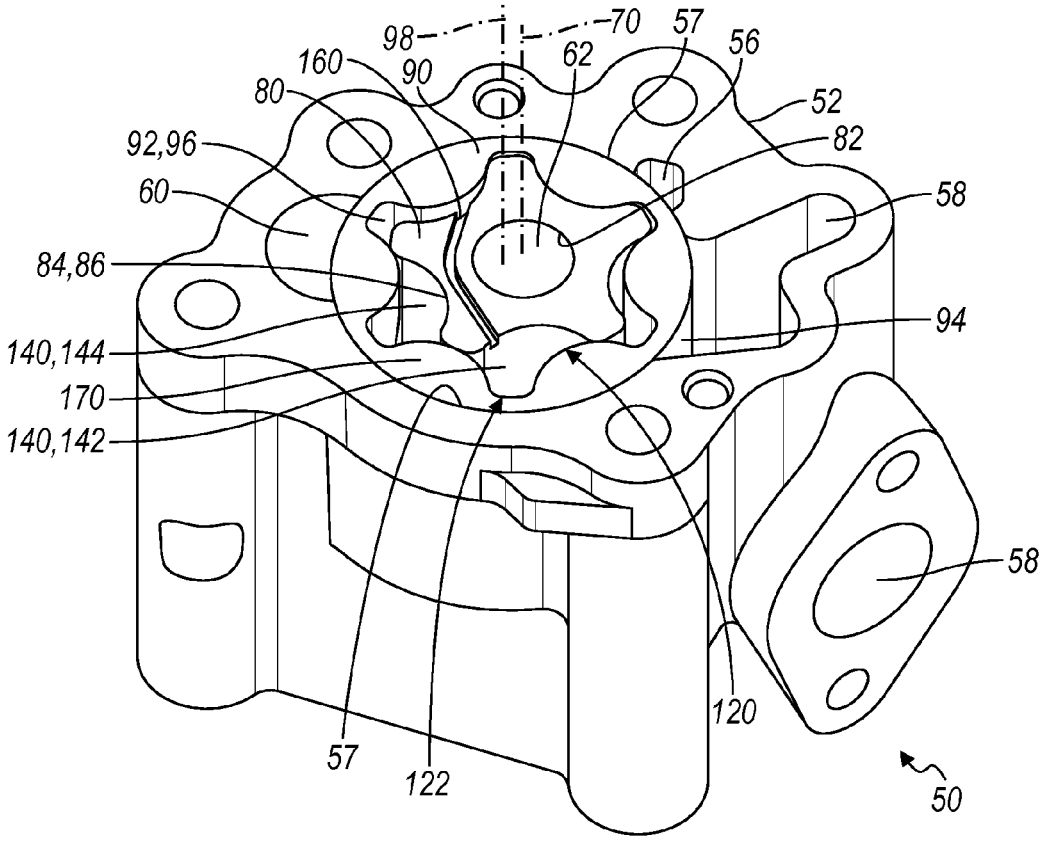
FIG. 2 illustrates a perspective sectional view of gerotor pump according to an embodiment.

The pump 50 has a fluid inlet 58 and a fluid outlet 60. The fluid inlet 58 has an inlet port as shown in FIG. 2 that is adapted to connect to a conduit such as intake 16 in fluid communication with a supply, such as an oil sump 14. The inlet port may be located on the housing 52 as shown, or may be defined by the cover. The fluid inlet 58 is fluidly connected with the chamber 56 and intersects the wall(s) 57 such that fluid within the inlet 58 flows into the chamber 56. Both the housing 52 and the cover may define portions of the inlet 58 region. The inlet 58 may be shaped to control various fluid flow characteristics.

The fluid outlet 60 has an outlet port that is adapted to connect to a conduit in fluid communication with an oil filter, a vehicle component such as an engine, etc. The outlet port may be located on the housing 52 as shown, or may be defined by the cover. The fluid outlet 60 is fluidly connected with the chamber 56 and intersects the wall(s) 57 such that fluid within the chamber 56 flows into the outlet 60. Both the housing 52 and the cover may define portions of the outlet 60 region. The outlet 60 may be shaped to control various fluid flow characteristics. The inlet 58 and the outlet 60 are spaced apart from one another by a section of wall 57, and in one example, may be generally opposed to one another.

The pump 50 has a pump shaft 62 or driveshaft. The pump shaft 62 is driven to rotate components of the pump 50 and drive the fluid. In one example, the pump shaft 62 is driven by a mechanical coupling with an engine, such that the pump shaft rotates as an engine component such as a crankshaft rotates, and a gear ratio may be provided to provide a pump speed within a predetermined range. In one example, an end of the pump shaft 62 is splined or otherwise formed to mechanically connect with a rotating vehicle component to drive the pump 50.

The other end of the shaft 62 is supported for rotation within the housing 52 of the pump 50. The housing may define a support for the end of the shaft to rotate therein, and the support 66 may include a bushing, a bearing connection, or the like. The shaft 62 rotates about a longitudinal axis 70 of the shaft 62.

The shaft 62 extends through the cover, and the cover may include an opening with a sleeve or a seal to retain fluid within the pump and prevent or reduce leakage from the chamber 56. The cover may also include additional bushings or bearing assemblies supporting the shaft 62 for rotation therein.

An inner rotor 80 or inner gear member is connected to the pump shaft 62 for rotation therewith. The inner rotor 80 has a body defining an inner surface or wall 82 and an outer surface or wall 84. The inner wall 82 is formed to couple with the pump shaft 62 for rotation therewith about the axis 70. In one example, the inner wall 82 is splined to mate with a corresponding splined section of the pump shaft 62. The outer wall 84 defines a series of external gear teeth 86. The inner rotor 80 may be defined as an externally toothed gear.

An outer rotor 90, outer gear member, or idler gear or rotor surrounds the inner rotor 80 and is supported for rotation within the chamber 56. The outer rotor 90 has an inner surface or wall 92 and an outer surface or wall 94. The inner wall 92 defines a series of internal gear teeth 96. The outer rotor 90 may be defined as an internally toothed gear. The outer wall 94 is cylindrical in shape and is sized to be received by and generally interface with the cylindrical wall sections of the housing for rotation therein about an axis 98. Axis 98 is the longitudinal or central axis of the cylindrical chamber 56 in the housing. The outer wall 94 may be directly adjacent to and may contact the cylindrical wall sections 57, as the wall sections 57 act to retain the outer rotor 90 in position during pump 50 operation.

The inner rotor 80 is rotated about axis 70 by the pump shaft 62. The series of teeth 86 on the inner rotor 80 have an addendum region 104 and a dedendum region 106 or pocket 106. The addendum region 104 is adjacent to the top land 108 of each tooth 110. The dedendum region 106 is adjacent to the bottom land 112 between adjacent teeth 110. Each of the addendum and dedendum regions 104, 106 may be formed by a cycloid shape, or another shape. In the example shown, the dedendum region 106 is formed by a cycloid or a hypocycloid shape such that the dedendum regions 106 are smooth curves. The pocket 106 includes the dedendum region and may additionally include at least a portion of the adjacent teeth 86, e.g. the sides or faces. The pocket 106 does not include the top lands 108 of the adjacent teeth 86.

The outer rotor 90 has a series of inner gear teeth 96 that have an addendum region 120 and a dedendum region 122. The addendum region 120 is adjacent to the top land of each tooth and the dedendum region 122 is adjacent to the bottom land between adjacent teeth. Each of the addendum and dedendum regions 120, 122 may be formed by a cycloid shape, or another shape. In the example shown, the addendum region 120 is formed by a cycloid or a hypocycloid shape such that the addendum regions 120 are smooth curves. The addendum region 120 is formed with the same curve or shape as the dedendum region 106 of the inner rotor 80 such that the regions 106, 120 mate to form a continuous seal.

As the inner rotor 80 is rotated by the shaft 62, the teeth 86 of the inner rotor 80 mesh with the teeth 96 of the outer rotor 90, and the outer rotor 90 is driven as an idler by the inner rotor 80. In the present example, the pump shaft 62 rotates the inner rotor 80 in a clockwise direction in FIG. 2, and the idler rotor 90 is therefore rotated in a clockwise direction by the inner rotor 80. The inner rotor 80 is eccentric relative to the outer rotor 90 and the cylindrical housing 56, 57. As the inner rotor 80 rotates about an axis 70 that is offset relative to the axis of rotation 98 of the outer rotor 90, variable volume pumping chambers are formed between the inner and outer rotors 80, 90 to drive fluid flow. As can be seen from FIG. 2, the pump 50 operates without a crescent shaped seal or insert in the chamber 56.

A plurality of chambers 140 are formed between the inner rotor 80 and the outer rotor 90. Each chamber 140 has a variable volume as the pump 50 operates. Each chamber 140 increases in volume to draw in the fluid from the inlet 58, and then decreases in volume to push the fluid out of the outlet 60. A chamber that is increasing in volume is shown at 142. A chamber that is decreasing in volume is shown at 144. As the inner rotor 80 rotates, the spacing between the outer wall 84 of the inner rotor 80 and the inner wall 92 of the outer rotor 90 changes at various radial locations about the inner rotor 80. The chamber formed by the inner rotor, vanes, and cam near the inlet port 58 increases in volume, which draws fluid into the chamber from the inlet port 58. The chamber near the outlet port 60 is decreasing in volume, which forces fluid from the chamber into the discharge port 60 and out of the pump.

Figure 3:
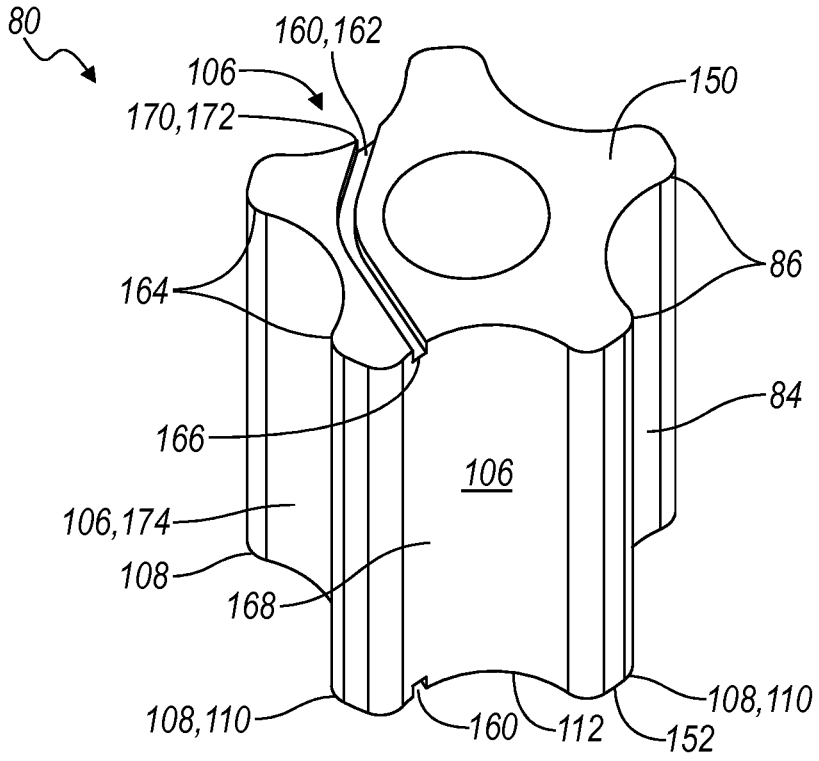
FIG. 3 illustrates a perspective view of an inner rotor for use with the pump of FIG. 2.

FIG. 3 illustrates an inner rotor 80 for use with the pump 50 of FIG. 2. The inner rotor 80 has a body defining a first end 150 and a second opposed end 152 spaced apart from the first end 150. The first second ends are connected by an outer wall 84 that defines the series of gear teeth 86 interposed with a series of pockets 106 or concave regions.

The inner rotor 80 has at least one fluid passage 160 therein. Each fluid passage 160 may be defined by an end face 150, 152 of the inner rotor 80. The fluid passage 160 fluidly connects alternating dedendum regions 106 or pockets of the inner rotor 80. The fluid passage 160 fluidly connects two pumping chambers 140 in the pump 50, and extends across two teeth of the inner rotor such that there are two top lands 108 and a pocket 106 or pumping chamber 140 positioned between ends of the passage 160. The passage 160 fluidly connects nonadjacent pumping chambers 140 or nonadjacent dedendum regions or pockets 106.

The fluid passage 160 may be provided as a groove or channel formed in at least one of the end faces 150, 152. In one example, the passage 160 is an open channel 162 formed in each end face 150, 152. The inner rotor 80 may have one fluid passage 160, two fluid passages 160 as shown, or more than two fluid passages 160. The open channels 162 cooperate with planar surfaces of the housing and/or the cover to generally form the fluid passage or pathway between nonadjacent pockets 106.

Generally, the fluid passage 160 is configured to disrupt harmonics during operation of the pump 50 to reduce pressure ripples and associated tonal noise. By placing a passageway 160 fluidly connecting some, but not all, of the pumping chambers 140 formed between teeth 86, the harmonics during pump operation are disrupted. The remaining pockets 106 or pumping chambers 140 between teeth 86 are independent of or are without passageways 160 such that they are fluidly isolated from adjacent and nonadjacent pumping chambers 140 by the teeth 86 to maintain overall pumping efficiency. Note that a conventional inner rotor is without passages 160.

Each fluid passage 160 is defined by a channel or groove 162 extending across two teeth 86, for example, teeth 164. Each channel 162 has a first end 166 that intersects the side wall 84 of the inner rotor 80 on an upstream side 168 or face of the tooth or adjacent to a dedendum region 106 on a first side of a tooth 164. Each channel 162 also has a second end 170 that intersects the side wall of the inner rotor on the downstream side 172 or face of another adjacent tooth 164 adjacent to a dedendum region 106 on the second side of that tooth. Each groove or channel 162 extends across the respective teeth 164 to fluidly connect nonadjacent pumping chambers 140 partially defined by the teeth 164.

An uninterrupted pocket 174 or dedendum region 106 and associated pumping chamber 140 is therefore positioned between the ends 166, 168 of the channel 162, and is not in fluid communication with the channel 162.

Each fluid passage 160 may have a groove 162 that is uniform along its length. In alternative examples, portions of the fluid passage 160 may have sections with increasing and/or decreasing tapered shapes along their length. The channel 162 may have various cross-sectional shapes including rectangular, curved, v-shaped, parabolic, other smooth continuous curves and/or linear discontinuous shapes. The cross-sectional shape of the fluid passages 160 may be constant or may change along its length. The fluid passages 160 may be the same size as shown, or may be different sizes. The fluid passages 160 may be similarly positioned with respect to teeth 164, or may be positioned differently relative to the teeth 164 and the inner rotor 80. Each end 166, 168 of the fluid passage may be positioned at a predetermined location in the dedendum region 106 or pocket, and these locations may vary between the upstream and downstream pockets, or may be similarly positioned.

Each fluid passage or groove may be linear or non-linear as shown. The pathway of the fluid passage may be constrained by the geometry of the inner rotor 80. The pathway of the fluid passage may also be shaped in a specific path to provide desired flow characteristics for fluid flowing in or out of the passage.

In one example, each channel 162 has cross-sectional dimensions of approximately 0.5 to 2 millimeters in width, and 0.5-3.0 millimeters in depth. In the example shown, each channel has dimensions of 1.5 millimeters in width and 1.5 millimeters in depth.

Figure 4:
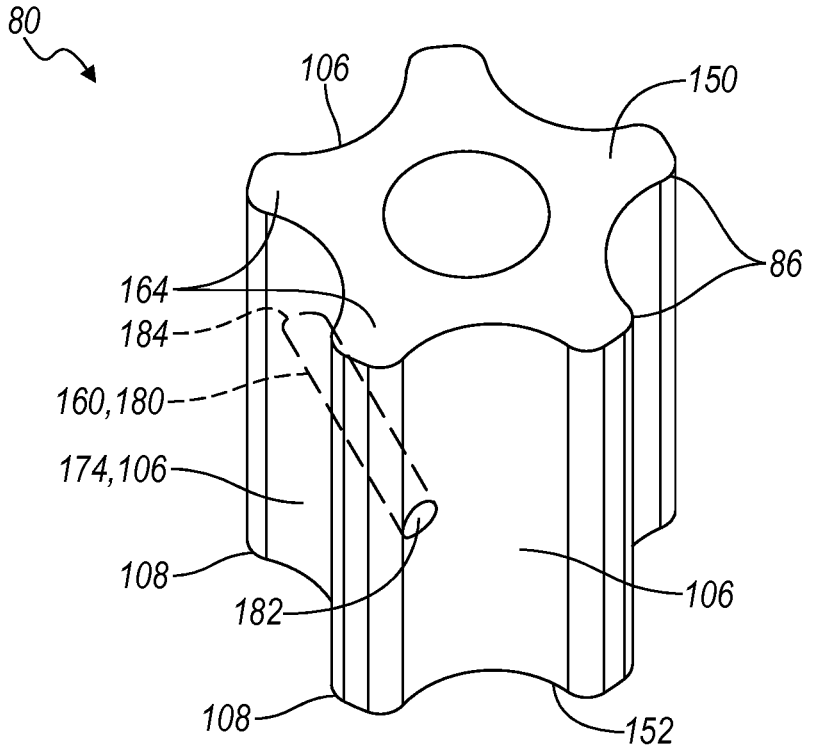
FIG. 4 illustrates a perspective view of another inner rotor for use with the pump of FIG. 2.
Figure 5:
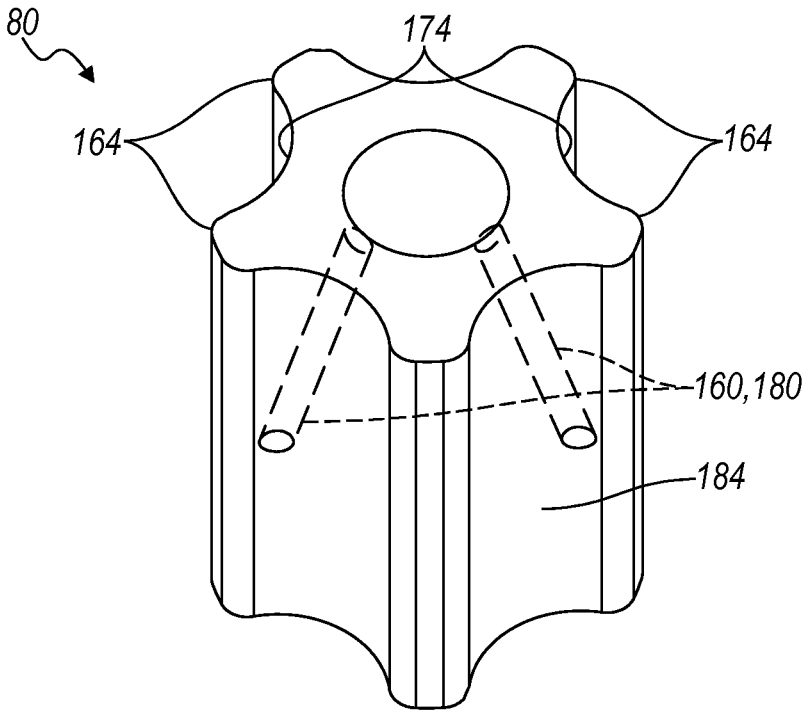
FIG. 5 illustrates a perspective view of yet another inner rotor for use with the gerotor pump of FIG. 2.
Figure 6:
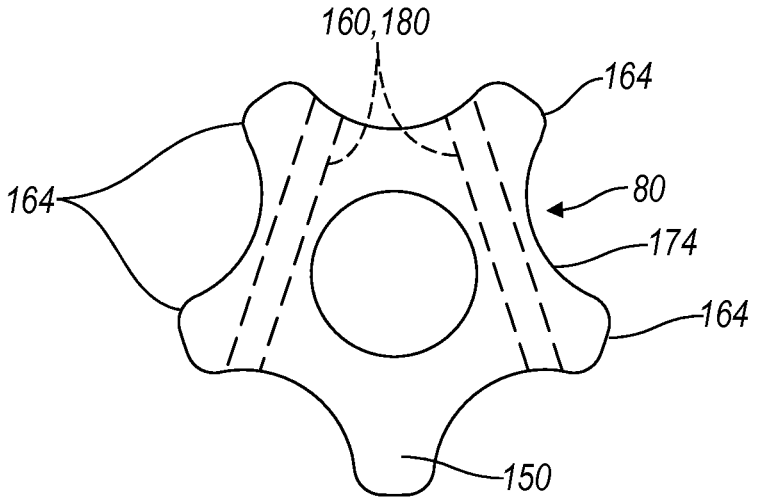
FIG. 6 illustrates a top view of the inner rotor of FIG. 5.

FIGS. 4-6 illustrates further examples of an inner rotor 80 for use with the pump 50 of FIG. 2. The inner rotor 80 has a first end 150 and a second opposed end 152 spaced apart from the first end 150. The first second ends are connected by an outer wall that defines the series of gear teeth 86.

The inner rotor 80 has at least one fluid passage 160 therein. Each fluid passage 160 is defined by the body of the inner rotor 80 and is spaced apart from the end faces 150, 152 of the inner rotor 80. The fluid passage 160 fluidly connects alternating dedendum regions 106 or pockets of the inner rotor 80. The fluid passage 160 fluidly connects two pumping chambers 140 in the pump 50, and extends across two teeth of the inner rotor such that there are two top lands 108 and a pocket 106 or pumping chamber 140 positioned between ends of the passage 160. The passage 160 fluidly connects nonadjacent pumping chambers 140 or nonadjacent dedendum regions or pockets 106.

The fluid passage 160 may be provided as a hole or aperture extending through an intermediate region of the inner rotor 80. In one example, the passage 160 is an aperture 180. The inner rotor 80 may have one fluid passage 160 as shown, or more than one fluid passage 160 as shown in FIGS. 5-6. The apertures 180 intersect the outer wall 84 of the inner rotor and generally form a fluid passage or pathway between nonadjacent pockets 106.

Generally, the aperture 180 forming the fluid passage 160 is configured to disrupt harmonics during operation of the pump 50 to reduce pressure ripples and associated tonal noise. By placing a passageway 160 fluidly connecting some, but not all, of the pumping chambers 140 formed between teeth 86, the harmonics during pump operation are disrupted. The remaining pockets 106 or pumping chambers 140 between teeth 86 are independent of passageways 160 such that they are fluidly isolated from adjacent and non-adjacent pumping chambers 140 by the teeth 86 to maintain overall pumping efficiency. Note that a conventional inner rotor is without passages 160.

Each fluid passage 160 is defined by an aperture 180 extending across two teeth 86, for example, teeth 164. Each aperture 180 has a first end 182 that intersects the side wall 84 of the inner rotor 80 on an upstream side 168 or face of the tooth or adjacent to a dedendum region 106 on a first side of a tooth 164. Each aperture 180 also has a second end 184 that intersects the side wall of the inner rotor on the downstream side 172 or face of another adjacent tooth 164 adjacent to a dedendum region 106 on the second side of that tooth. Each aperture 180 extends across the respective teeth 164 to fluidly connect nonadjacent pumping chambers 140 partially defined by the teeth 164.

An uninterrupted pocket 174 or dedendum region 106 and associated pumping chamber 140 is therefore positioned between the ends 182, 184 of the aperture 180, and is not in fluid communication with the aperture 180.

Each fluid passage 160 may have an aperture 180 that is uniform along its length. In alternative examples, portions of the fluid passage 160 may have sections with increasing and/or decreasing tapered shapes along their length. The aperture 180 may have various cross-sectional shapes including circular, elliptical, slotted, rectangular, other smooth continuous curves and/or linear discontinuous shapes. The cross-sectional shape of the fluid passages 160 may be constant or may change along its length. The fluid passages 160 may be the same size as shown, or may be different sizes. The fluid passages 160 may be similarly positioned with respect to teeth 164, or may be positioned differently relative to the teeth 164 and the inner rotor 80. Each end 182, 184 of the fluid passage may be positioned at a predetermined location in the dedendum region 106 or pocket, and these locations may vary between the upstream and downstream pockets, or may be similarly positioned. Although only one aperture 180 is shown fluidly connecting nonadjacent pockets 106, more than one aperture 180 may also be provided to fluidly connect the same nonadjacent pockets.

Each fluid passage or groove may be linear as shown or non-linear. The pathway of the fluid passage may be constrained by the geometry of the inner rotor 80. The pathway of the fluid passage may also be shaped in a specific path, for example, to provide desired flow characteristics for fluid flowing in or out of the passage.

The body of the inner gear member 80 or inner rotor defines a series of (N) teeth 86 having (N) associated pockets 106. The inner gear member 80 has less than (N) pockets in fluid communication with a passage 160. The (N) pockets are nonsequentially arranged in the series of pockets 106 and teeth 86 such that at least one pocket 174 without a fluid passage 160 is positioned between two pockets 106 each having a passage 160. Therefore, the pockets 106 with fluid passages 160 are nonadjacent to one another, and adjacent fluid pockets are not in fluid communication with one another. Note that the outer gear member 90 has a series of (N−1) teeth. Alternate teeth in the series of teeth 86 or fewer teeth may be provided with fluid passages. For an inner rotor 80 with more than one fluid passageways 160 across different pockets 174, as shown in FIGS. 5-6, the passageways 160 may share a common pocket 106 at one end and may be in fluid communication with different pockets 106 at the other ends. Adjacent pocket 106 and pumping chambers 140 are not in fluid communication with one another. In other words, nonadjacent or nonsequential pockets 106 are fluidly connected by fluid passageways 160 in the rotor 80.

In the example shown in FIG. 3 or 4, N=5 such that the inner rotor 80 is provided with five teeth 86 and five pockets 106. Two of the nonadjacent pockets 106 are fluidly connected by fluid passages 160, and the remaining three pockets 106 are independent of fluid passages 160.

In the example shown in FIG. 5, N=5 such that the inner rotor 80 is provided with five teeth 86 and five pockets 106. The rotor 80 has two fluid passageways 160 that fluidly connect different pockets 106. The first fluid passageway 160 fluidly connects a first and third pockets 106, and the second fluid passageway fluidly connects the third and fifth pockets 106. Therefore, in effect, the first, third, and fifth fluid pockets 106 are in fluid communication with one another. The second and fourth pockets are independent of fluid passages 160.

As the gerotor pump 50 operates, pressure ripples of the fluid in the pump 50 may act as a source of excitation to powertrain components, for example, when the pump 50 is mounted to the powertrain components. The fundamental frequency of the peak pressure and its harmonics correspond to the number (N) of inner rotor teeth. For example, the pump 50 may be mounted to an engine block, a transmission housing, an oil pan or sump housing, a transmission bell housing, and the like, where the pressure ripples may cause tonal noise or whine from the engine or the transmission. The inner rotor 80 design of the present disclosure acts to reduce or eliminate the oil pump-induced powertrain whine or tonal noise by providing pressure relief or acting in a bypass capacity.

The pump 50 has an inner rotor 80 with fluid passages 160 that act to break down the harmonics of the pump. Since the fluid passages 160 are implemented in only some of the pockets 106, only fluidly connect alternating pockets, and are not provided to all of the pockets 106 and associated pumping chambers 140, the oil pump main order and its harmonics breaks down over a larger frequency range with reduced pressure fluctuations and reduced harmonics amplitude.

Conventional gerotor pumps exhibit strong pressure spikes over a very narrow band frequency limited to the pump orders. The pump 50 according to the present disclosure reduces the pressure spikes and spreads them over a larger frequency range. The lower amplitude pressure spikes along with an increased frequency and more uniform frequency distribution provides for tonal noise reduction.

The fluid passages 160 of the inner rotor 80 provide pressure relief for the pump 50 and act to reduce the tonal noise or whine. As the pump 50 operates, fluid within variable volume chambers 140 adjacent to the outlet 60 is able to flow from the chambers 140 through the passages 160 and to the outlet region 60. Modeling and testing of the inner rotor 80 with the fluid passages 160 show improved pump 50 operating characteristics compared to a pump having a conventional inner rotor and pump housing.

Figure 7:
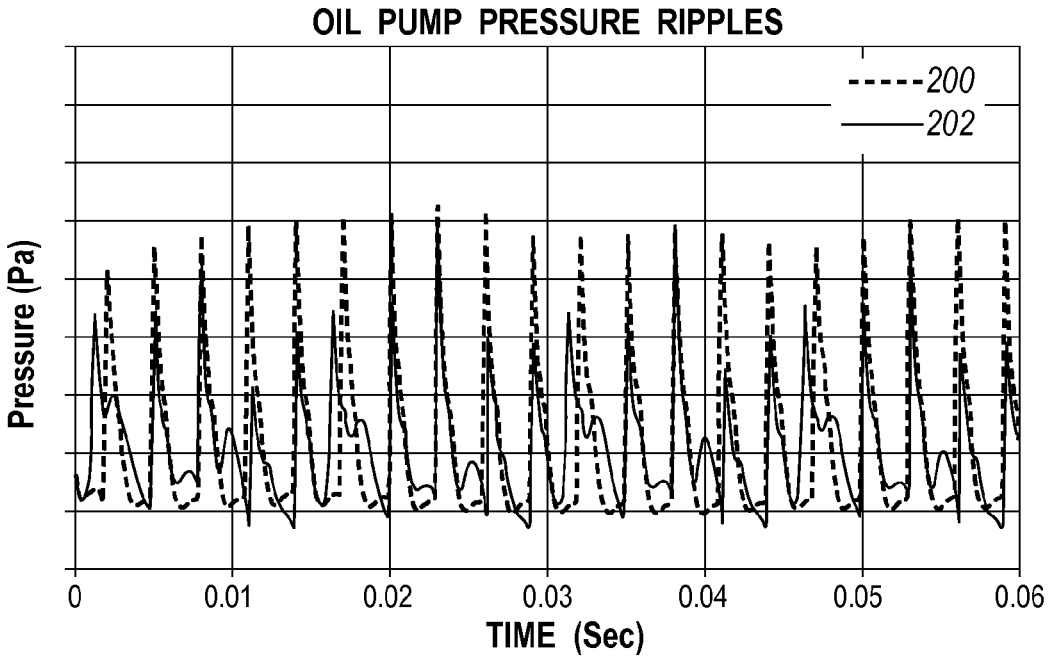
FIG. 7 illustrates a graph of pressure output from the pump of FIG. 2 with the inner rotor of FIG. 3 compared to a pressure output from a pump with a conventional idler rotor.
Figure 8:
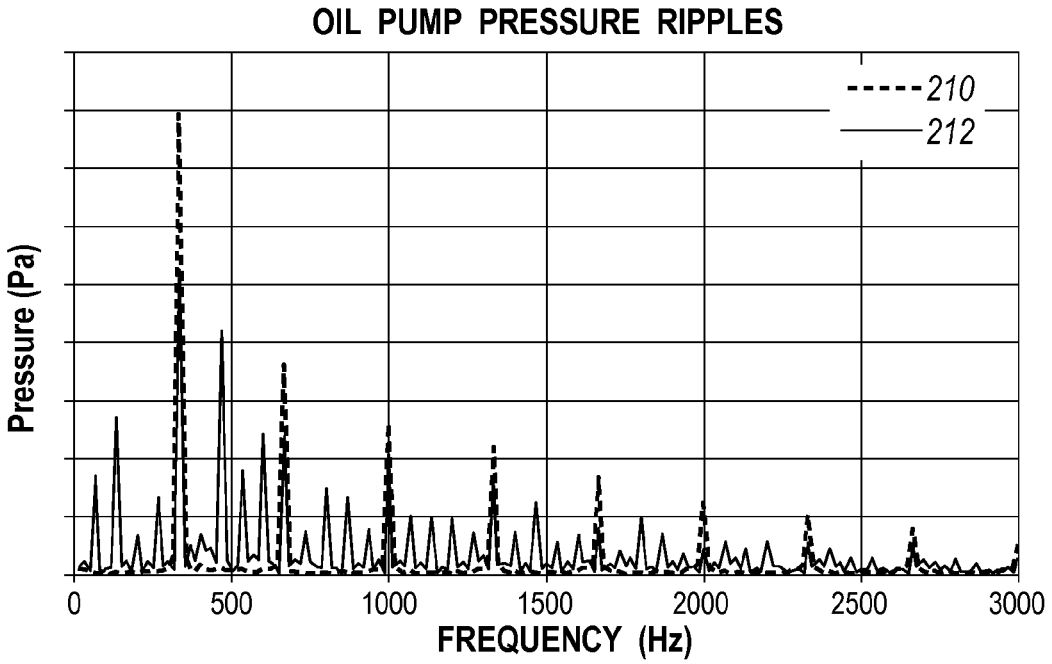
FIG. 8 illustrates a frequency domain analysis for the pump of FIG. 2 with the inner rotor of FIG. 3 compared to a pump with a conventional idler rotor.

Modeling results are provided in FIGS. 7-8 and are based on a gerotor pump with an inner rotor 80 having five teeth 86 with fluid passages 160 provided by grooves 162 as shown in FIG. 3, and operating at 4000 rpm as determined using computational fluid dynamics (CFD) analysis. The inner rotor 80 has two grooves 162 as shown in FIG. 3, with each groove having a width of 0.5 mm and a depth of 0.5 mm. A gerotor pump 50 having the inner rotor 80 as described herein showed a reduction in pressure ripples or spikes during operation. The passageways 160 act to break down the harmonics caused by the rotation of the inner rotor 80 and act to reduce the pressure ripples and reduce the tonal noise or whine by providing pressure relief and limited fluid flow from adjacent pumping chambers to the pump outlet.

Modeling results of the average volumetric flow rate (gallons per minute) of a conventional pump compared to the pump 50 showed comparable flow rates. For example, with considered geometrical dimensions at 4000 rpm, approximately a 2% reduction in flow rate for the pump 50 compared to a conventional pump is predicted. If necessary, this small amount of flow reduction may be compensated by a slight upsizing of the pump.

For example, as shown in FIG. 7, a conventional pump while operating may provide fluid at the outlet of the pump with pressure fluctuations or pressure waves as shown by line 200 during a steady state operating condition. These pressure fluctuations are a difference between a maximum fluid pressure or spike and a minimum fluid pressure at the outlet. The pump 50 according to the present disclosure has a pressure fluctuation as shown by line 202 for the same steady state operating condition. The pump 50 according to the present disclosure provides for a wider pressure spike with a lower amplitude at the pump outlet compared to the conventional pump across a range of pump speeds. Therefore, the pump 50 according to the present disclosure does not incur any significant losses based on differences in efficiencies, etc.

FIG. 8 shows the pressure ripples profiles in the frequency domain at the outlet of the pump 50 according to the present disclosure compared to a conventional pump. An analysis across a frequency domain showed a significant decrease in pressure peaks for the various orders of the pump 50, with the pressure peaks essentially disappearing for the higher orders as shown in FIG. 8, with a conventional pump illustrated by line 210, and a pump 50 according to the present disclosure illustrated by line 212. The fundamental frequency of the pump, i.e., first order, and the higher order harmonics are determined by the number of teeth 86 on the inner rotor 80. The inner rotor 80 of the pump has five teeth, therefore, for the pump running at 4000 rpm, the harmonic orders of the pump due to the pressure pulsations are multiples of five with the first order at 333 Hertz and the second order appearing at 666 Hertz.

From FIG. 8 in the frequency domain, the lower pressure amplitudes for orders beyond the fundamental orders may be seen, and is a typical characteristic of gerotor pumps. The tonal noise is usually due to the higher orders of the pump and reduction in amplitude for the first order which corresponds to the pump pressure ripples usually is not enough to resolve the whine issue. For a vehicle component oil pump NVH assessment, pump pressure fluctuations at higher frequency orders are therefore considered, and may be decreased to reduce tonal noise.

Figure 9:
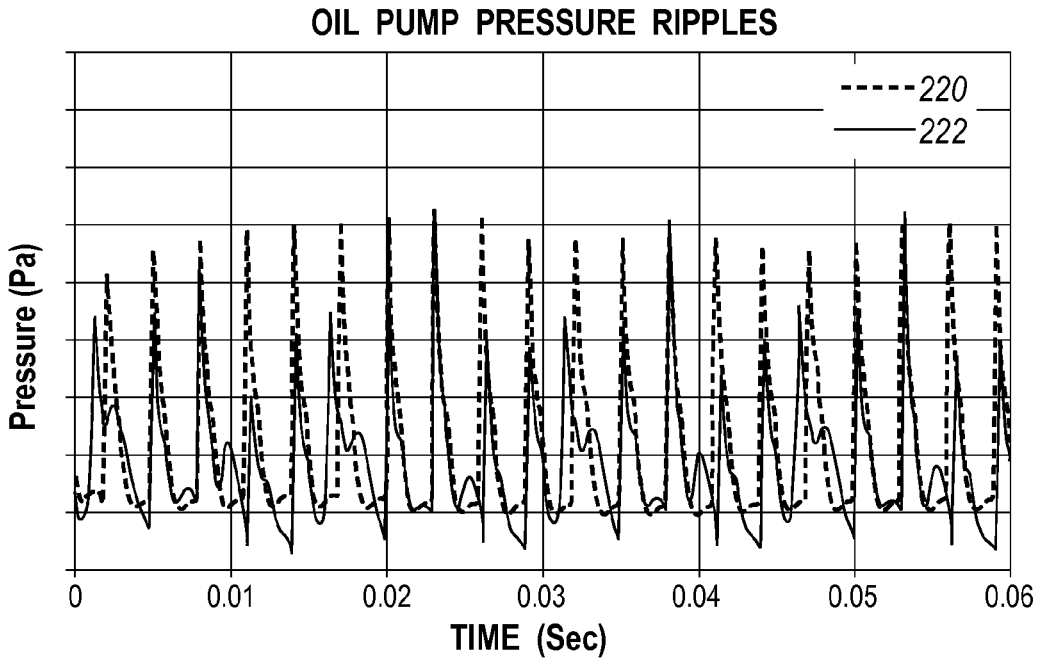
FIG. 9 illustrates a graph of pressure output from the pump of FIG. 2 with the inner rotor of FIG. 4 compared to a pressure output from a pump with a conventional idler rotor.
Figure 10:
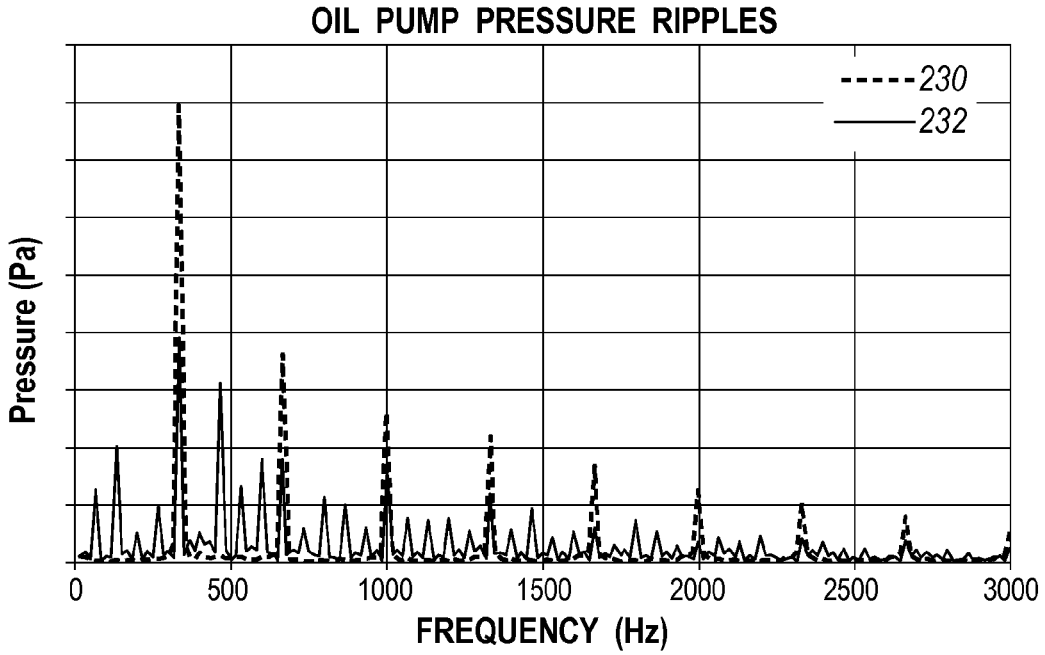
FIG. 10 illustrates a frequency domain analysis for the pump of FIG. 2 with the inner rotor of FIG. 4 compared to a pump with a conventional idler rotor.

Modeling results are provided in FIGS. 9-10 and are based on a gerotor pump with an inner rotor 80 having five teeth 86 with fluid passages 160 provided by aperture 180 as shown in FIG. 4, and operating at 4000 rpm as determined using computational fluid dynamics (CFD) analysis. The inner rotor 80 has one aperture 180 as shown in FIG. 4, and has a circular cross-sectional shape with a diameter of 3.5 mm. A gerotor pump 50 having the inner rotor 80 as described herein showed a reduction in pressure ripples or spikes during operation. The passageway 160 acts to break down the harmonics caused by the rotation of the inner rotor 80 and act to reduce the pressure ripples and reduce the tonal noise or whine by providing pressure relief and limited fluid flow from adjacent pumping chambers to the pump outlet.

Modeling results of the average volumetric flow rate (gallons per minute) of a conventional pump compared to the pump 50 showed comparable flow rates. For example, with considered geometrical dimensions at 4000 rpm, approximately a 2% reduction in flow rate for the pump 50 compared to a conventional pump is predicted.

For example, as shown in FIG. 9, a conventional pump while operating may provide fluid at the outlet of the pump with pressure fluctuations or pressure waves as shown by line 220 during a steady state operating condition. These pressure fluctuations are a difference between a maximum fluid pressure or spike and a minimum fluid pressure at the outlet. The pump 50 according to the present disclosure has a pressure fluctuation as shown by line 222 for the same steady state operating condition. The pump 50 according to the present disclosure provides for a wider pressure spike with a lower amplitude at the pump outlet compared to the conventional pump across a range of pump speeds. Therefore, the pump 50 according to the present disclosure does not incur any significant losses based on differences in efficiencies, etc.

FIG. 10 shows the pressure ripples profiles in the frequency domain at the outlet of the pump 50 according to the present disclosure compared to a conventional pump. An analysis across a frequency domain showed a significant decrease in pressure peaks for the various orders of the pump 50, with the pressure peaks essentially disappearing for the higher orders as shown in FIG. 8, with a conventional pump illustrated by line 230, and a pump 50 according to the present disclosure illustrated by line 232. The fundamental frequency of the pump, i.e., first order, and the higher order harmonics are determined by the number of teeth 86 on the inner rotor 80. The inner rotor 80 of the pump has five teeth, therefore, for the pump running at 4000 rpm, the harmonic orders of the pump due to the pressure pulsations are multiples of five with the first order at 333 Hertz and the second order appearing at 666 Hertz.

From FIG. 8 in the frequency domain, the lower pressure amplitudes for orders beyond the fundamental orders may be seen, and is a typical characteristic of gerotor pumps. The tonal noise is usually due to the higher orders of the pump and reduction in amplitude for the first order which corresponds to the pump pressure ripples usually is not enough to resolve the whine issue. For a vehicle component oil pump NVH assessment, pump pressure fluctuations at higher frequency orders are therefore considered, and may be decreased to reduce tonal noise.

The pump 50 according to the present disclosure provides for decreased noise. For example, when the pump 50 according to the present disclosure is used with a powertrain for a vehicle the tonal noise from the powertrain is reduced. The tonal noise reduction using the pump 50 may provide for reduced noise, vibration, and harshness (NVH) from the powertrain. Additionally, the powertrain or lubrication system may be simplified using a pump 50 according to the present disclosure. For example, the powertrain or lubrication system with a conventional pump may include noise reduction devices or features, and these features may be eliminated by switching to a pump according to the present disclosure. In one example, the conventional lubrication system includes a damping material such as a mastic located on the oil sump, and this damping material may be removed by switching to a pump 50 as described herein without an increase in tonal noise from the powertrain.

While exemplary embodiments are described above, it is not intended that these embodiments describe all possible forms of the disclosure. Rather, the words used in the specification are words of description rather than limitation, and it is understood that various changes may be made without departing from the spirit and scope of the disclosure. Additionally, the features of various implementing embodiments may be combined to form further embodiments of the disclosure.

What is claimed is:

1. A gerotor pump comprising:

a pump housing defining a chamber and having a fluid inlet and a fluid outlet;

an outer gear member supported for rotation within the chamber about a first axis, the outer gear member having a series of internal teeth; and an inner gear member rotatably supported within the outer gear member about a second axis spaced apart from the first axis, the inner gear member defining a series of external teeth interposed with a series of external pockets, the inner gear member defining a fluid passage therethrough to fluidly connect two nonadjacent pockets, another pocket independent of fluid passages, the fluid passage being configured to disrupt harmonics during operation to reduce pressure ripples and associated tonal noise.

2. The pump of claim 1 wherein the another pocket is positioned between and separates the two nonadjacent pockets.

3. The pump of claim 1 wherein the inner gear member and the outer gear member cooperate to form a plurality of variable volume pumping chambers to pump fluid from the fluid inlet to the fluid outlet.

4. The pump of claim 1 wherein the fluid passage is defined by a groove in an end face of the inner gear member.

5. The pump of claim 4 wherein the fluid passage is further defined by a second groove in another end face of the inner gear member.

6. The pump of claim 4 wherein the fluid passage is defined by an aperture extending through a body of the inner gear member, and positioned between first and second end faces of the inner gear member.

7. The pump of claim 1 wherein the inner gear member defines another fluid passage therethrough to fluidly connect another two nonadjacent pockets, the another fluid passage being configured to disrupt harmonics during operation to reduce pressure ripples and associated tonal noise.

8. The pump of claim 1 wherein the fluid passage provides a fluid connection between a first pumping chamber associated with a first end of the fluid passage and a second pumping chamber associated with a second end of the fluid passage.

9. The pump of claim 1 wherein the fluid passage is the only fluid passage defined within the inner gear member.

10. The pump of claim 1 wherein the fluid passage has a first end adjacent to a dedendum region on an upstream side of a first tooth, and a second end adjacent to a dedendum region on a downstream side of a second tooth, the first tooth being adjacent to the second tooth.

11. The pump of claim 1 wherein the inner gear member has (N) teeth, and the outer gear member has (N−1) teeth.

12. A gerotor pump comprising:

a housing forming an inlet and an outlet in a chamber; and an inner rotor positioned within an idler rotor, and having first, second and third dedendum regions arranged sequentially, the inner rotor defining a fluid passage extending between the first and third dedendum regions, the second dedendum region being without fluid passages.

13. The pump of claim 12 wherein each dedendum region of the inner rotor cooperates with the idler rotor to form a variable volume pumping chamber.

14. The pump of claim 12 wherein the inner rotor has a first end and a second opposed end, the passage being defined by a groove in the first end.

15. The pump of claim 14 wherein the passage is further defined by another groove in the second end.

16. The pump of claim 12 wherein the inner rotor has a first end and a second opposed end, the passage being defined by an aperture spaced apart from the first and second ends.

17. An inner rotor for a gerotor pump comprising:

a body having first and second end walls separated by an outer wall defining a series of teeth having first and second teeth positioned between first, second, and third sequentially arranged dedendum regions, respectively, the body defining a fluid passage extending between and connecting the first and third dedendum regions, the fluid passage having a first end intersecting a first face of the first tooth forming a portion of the first dedendum region, the fluid passage having a second end intersecting a second face of the second tooth forming a portion of the third dedendum region, wherein a second face of the first tooth and a first face of the second tooth meet and form the second dedendum region, the second dedendum region being without fluid passages.

18. The inner rotor of claim 17 wherein the fluid passage is the only fluid passage defined within the inner rotor.

* * * * *